US009605922B1

(12) United States Patent
Rowe

(10) Patent No.: US 9,605,922 B1
(45) Date of Patent: Mar. 28, 2017

(54) SLINGSHOT FIREARM

(71) Applicant: Clinton A. Rowe, Spruce Home (CA)

(72) Inventor: Clinton A. Rowe, Spruce Home (CA)

( * ) Notice: Subject to any disclaimer, the term of this patent is extended or adjusted under 35 U.S.C. 154(b) by 0 days.

(21) Appl. No.: 15/019,057

(22) Filed: Feb. 9, 2016

Related U.S. Application Data

(60) Provisional application No. 62/113,766, filed on Feb. 9, 2015.

(51) Int. Cl.
*F41B 3/02* (2006.01)
*F41B 3/00* (2006.01)
*F41G 1/46* (2006.01)

(52) U.S. Cl.
CPC ..... *F41B 3/005* (2013.01); *F41G 1/46* (2013.01)

(58) Field of Classification Search
CPC ..... F41B 3/02; F41B 3/005; F41B 5/12
See application file for complete search history.

(56) References Cited

U.S. PATENT DOCUMENTS 857,379 A 6/1907 Boyd
1,832,340 A 11/1931 Williams
2,040,150 A 5/1936 Merrill
2,501,568 A 3/1950 Jamagin
2,638,885 A 5/1953 Keadle
3,857,379 A 12/1974 Burghardt
4,593,673 A 6/1986 Kees
4,784,106 A * 11/1988 Kees ..... F41B 3/005 124/16
5,115,795 A 5/1992 Farris
5,931,145 A * 8/1999 Oviedo-Reyes ..... F41B 5/12 124/20.3
6,564,787 B1 5/2003 Barry
7,168,424 B1 1/2007 Wing
7,543,579 B2 * 6/2009 Chang ..... F41A 9/64 124/20.1
2014/0311470 A1 * 10/2014 Sievers ..... A63H 33/18 124/7
2015/0260478 A1 * 9/2015 Park ..... F41B 5/12 124/20.3

* cited by examiner

*Primary Examiner* — John Ricci
(74) *Attorney, Agent, or Firm* — Robert C. Montgomery; Montgomery Patent & Design, LP.

(57) ABSTRACT

A weapon includes a stock; a slide member connected and linearly movable relative to the stock, the slide member being movable between a rearward slide member position and a forward slide member position; a sling connected to the slide member and configured to be drawn back under tension to project a projectile upon release of the tension; and a firing action configured to selectively retain the sling in a drawn back position and release the sling to project the projectile.

18 Claims, 5 Drawing Sheets

SLINGSHOT FIREARM

RELATED APPLICATIONS

The present invention is a continuation-in-part of, was first described in, and claims the benefit of U.S. Provisional Application No. 62/113,766, filed Feb. 9, 2015 the entire disclosures of which are incorporated herein by reference.

FIELD OF THE INVENTION

The present invention relates generally to projectile weapons and, more particularly, to an elongated slingshot including an internal compartment suitably sized to hold a quantity of preferred projectiles for the weapon and a laser pointer.

BACKGROUND OF THE INVENTION

Two (2) formidable items when one thinks of weapons are the rifle and the sling shot. Unfortunately, each of these weapons suffer from their own unique disadvantages.

The rifle is known for being highly accurate and easy to control, especially when the target is kept under the sights for long periods of time. Of course it is somewhat noisy, and ammunition quickly runs out if used excessively, or over long periods of time when ammunition is limited. It is also somewhat of an overkill should the target be small and/or close by.

The slingshot, on the other hand, is perfect for close targets, stealthy quiet, and can use almost anything as ammunition, even rocks. However, it suffers from accuracy issues, and is somewhat difficult to hold in an armed position for any period of time more than a few seconds.

Accordingly, there exists a need by which the benefits of a rifle and a slingshot can be combined to produce a weapon with advantages of both.

SUMMARY OF THE INVENTION

The inventor has recognized the aforementioned inherent problems and lack in the art and observed that there is a need a weapon that combines the functions and advantages of both a rifle and a slingshot. The disclosed slingshot long-weapon, which will be described in greater detail herein, substantially departs from conventional solutions to fulfill this need by providing a user with the versatility and power of a sling shot and the accuracy and controllability of a rifle.

In one embodiment, the disclosed weapon includes a stock, a slide member connected and linearly movable relative to the stock, the slide member being movable between a rearward slide member position and a forward slide member position, a sling connected to the slide member and configured to be drawn back under tension to project a projectile upon release of the tension, and a firing action configured to selectively retain the sling in a drawn back position and release the sling to project the projectile.

In another embodiment, the disclosed weapon includes a stock including a slide cavity, a slide member connected to the stock and linearly movable relative to the stock within the slide cavity between a rearward slide member position and a forward slide member position, the slide member including a slide member first end and a slide member second end, at least a portion of the slide member about the slide member second end extends outwardly from the slide cavity, a slide latch mechanism disposed within the slide cavity, the slide latch mechanism engages the slide member to allow linear movement of the slide member out from the slide cavity and selectively restrain linear movement of the slide member into the slide cavity, a sling connected to the slide member second end, the sling configured to be drawn back under tension to project a projectile upon release of the tension, and a firing action configured to selectively retain the sling in a drawn back position and release the sling to project the projectile.

In another embodiment, the disclosed weapon includes a stock including a butt, a fore end extending from the butt, wherein the fore end includes a slide cavity, a grip positioned between the butt and the fore end, wherein the grip includes a thumbhole, and a trigger guard adjacent to the grip, a slide member movably connected to the fore end within the slide cavity between a rearward slide member position and a forward slide member position, wherein the slide member includes a first end located within the slide cavity, and an opposed second end at least partially extending outwardly from the fore end, a sling connected to the second end of the slide member, wherein the sling includes a firing yoke including a horizontal yoke member connected to the second end of the slide member, and a perpendicularly opposed pair of vertical yoke arms connected to the horizontal yoke, rubber bands including a first end and an opposed second end, wherein the first end of each one of the rubber bands is connected to an associated one of the pair of vertical yoke arms, the rubber bands configured to be drawn back under tension to project a projectile upon release of the tension, a pouch connected to the second end each one of the rubber bands, a foot hold connected to the second end of slide member; a firing action disposed within the stock, wherein the firing action includes a firing pin being movable between a forward firing pin position and a rearward firing pin position, and a pair of fingers being movable between a closed position to hold the rubber bands under the tension and an open position to release the tension, and a trigger configured to one (1) of selectively retain the firing pin in the rearward firing pin position or release the firing pin in the forward firing pin position, wherein, when in the rearward slide member position, the slide member moves the firing pin in the rearward firing pin position, and wherein, when in the rearward firing pin position, the firing pin retains the pair of fingers in the closed position.

Furthermore, the described features and advantages of the various embodiments disclosed by the present disclosure may be implemented or combined in various manners as one skilled in the relevant art will recognize. The various implementations and/or combinations can be practiced without one (1) or more of the features and advantages described in any particular disclosed embodiment.

Further advantages of the embodiments disclosed by the present disclosure will become apparent from a consideration of the drawings and ensuing description.

BRIEF DESCRIPTION OF THE DRAWINGS

The advantages and features of the various embodiments disclosed by the present disclosure will become better understood with reference to the following more detailed description and claims taken in conjunction with the accompanying drawings, in which like elements are identified with like symbols, and in which:

DESCRIPTIVE KEY

Figure 1:
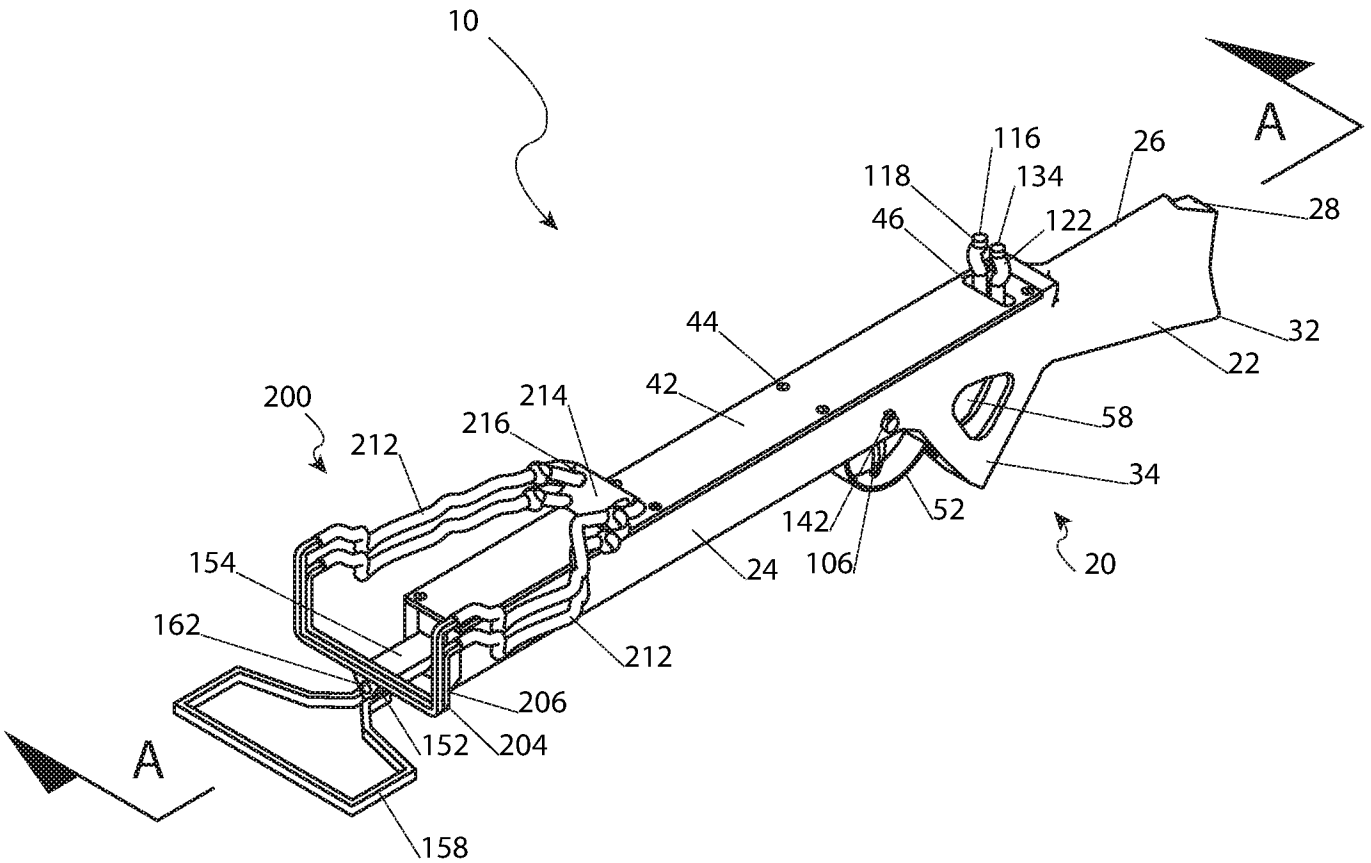
FIG. 1 is an isometric view of a slingshot long-weapon in accordance with one embodiment of the present invention.

10 slingshot long-weapon
20 stock
22 butt
24 fore-end
26 comb
28 heel
32 toe
34 grip
36 action cavity
38 safety pin aperture
42 top plate
44 plate fastener
46 plate aperture
52 trigger guard
54 guard fastener
56 trigger gap
58 thumbhole
62 projectile storage cavity
64 cap
66 slide cavity
68 latch cavity
70 action
72 mounting plate
74 mounting plate fastener
76 trigger clevis
78 trigger pivot pin
82 front plate
84 front plate aperture
86 rear plate
88 rear plate aperture
92 trigger notch
94 firing pin
96 flange
98 first end
100 second end
102 trigger groove
104 return spring
106 trigger
108 trigger pivot
112 firing pin actuator
116 first finger
118 first end
122 curve
124 vertical
126 bend
128 base
132 finger pivot
134 second finger
136 finger pivot post
138 finger pivot fastener
142 safety pin
144 safety pin spline
146 gap
150 slide
152 slide member
154 crest
156 detent
158 foothold
162 laser cavity
164 adjustment screw
166 laser pointer
168 mounting ring
170 slide latch mechanism
172 latch bar
174 latch spring
176 latch bar pivot
178 latch bar clevis
182 latch pin
184 latch plate
192 latch release button
194 button aperture
200 sling
202 firing yoke
204 yoke arm
206 double end
208 horizontal member
212 rubber band
214 pouch
216 pouch aperture
300 projectile

DETAILED DESCRIPTION OF THE PREFERRED EMBODIMENT

In accordance with the disclosed invention, the best mode is presented in terms of a one or more of the disclosed embodiments, herein depicted within FIGS. 1 through 8. However, the disclosure is not limited to a single described embodiment and a person skilled in the art will appreciate that many other embodiments are possible without deviating from the basic concept disclosed by the present disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

As used herein, the terms "first", "second", "third", etc. are used as labels to describe various elements, features, and/or components, and are not intended to impose ordinal, positional, or hierarchical requirements on the referenced items, unless other indicated. For example, such terms may be used to distinguish one (1) element from another element.

As used herein, relative terms such as "front", "rear", "left", "right", "top", "bottom", "below", "above", "upper", "lower", "horizontal", or "vertical" are used to describe a relationship of one (1) element, feature and/or region to another element, feature and/or region as illustrated in the figures.

Referring to FIGS. 1-8, disclosing a slingshot long-weapon (herein described as the "apparatus") 10, where like reference numerals represent similar or like parts. Generally, the disclosed apparatus 10 provides the functionality of a slingshot that is capable of imparting a greater amount of energy to a projectile due to the extended length of the overall configuration.

Generally, the apparatus 10 includes a foothold 158 mechanism that essentially allows energy-storing rubber bands 212 to be extended with the power of one (1) or two (2) hands. The rubber bands 212 are retained in a ready-to-fire position by a set of retaining fingers 116, 134 in an action 70 while a user takes a careful aim at an intended target with the assistance of an included laser pointer 166. After releasing a projectile 300 from the action 70, another projectile 300 can be removed from a projectile storage cavity 62 provided in a stock 20 of the apparatus 10 to prepare for an ensuing release.

Figure 2:
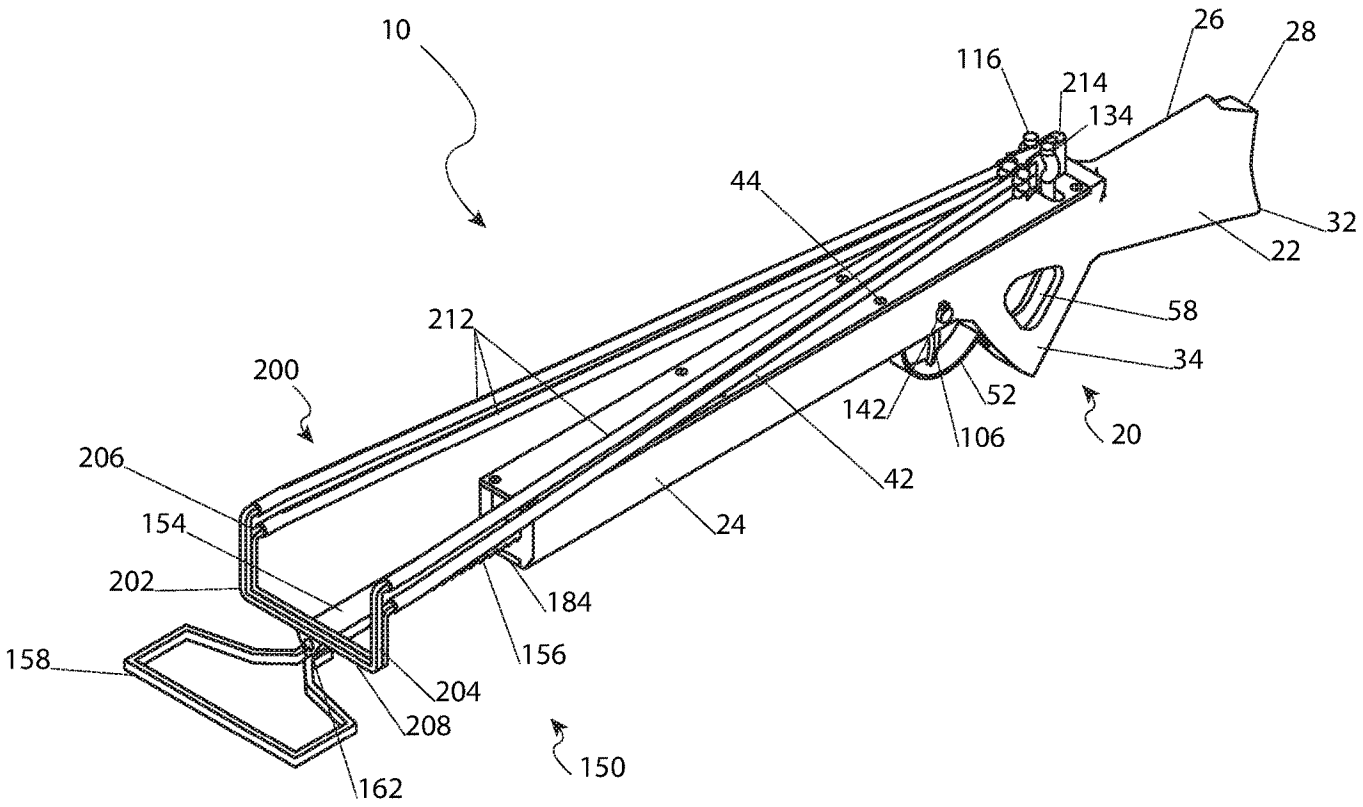
FIG. 2 is an isometric view of the slingshot long-weapon in an extended configuration.

Referring to FIG. 1, an isometric view of the apparatus 10, and FIG. 2, an isometric view of the apparatus 10, with a slide member 152 in an extended configuration, are disclosed. The apparatus 10 includes the action 70 incorporated within the stock 20, the slide member 152 to which a firing yoke 202 is mounted, and a sling 200 that includes rubber bands 212 and a pouch 214.

The stock 20 is configured to generally be a traditional single-piece gunstock, having a butt 22 with a thumbhole 58, and a fore-end 24. The stock 20 may be composed of any of a variety of hardwood typically utilized for that purpose such as ash, oak, maple, or walnut, and could even include any exotic wood, such as rosewood, or teak. Other materials, such as cast metals, composite materials, or thermoplastics, may also be utilized without limiting the scope of the present disclosure. The wood, or other constituent material, of the stock 20 may be finished with any acceptable coating, or plating material, as may suit the taste of a particular user.

The butt 22 is configured to have an elliptical, or modified elliptical, cross-section. It is understood that alternate embodiments may incorporate other cross-sectional shapes without limiting the scope of the present disclosure. In one (1) embodiment, the butt 22 is provided with a notched comb 26 terminating at a heel 28 located at an upper extent of a proximal end of the butt 22. This proximal end of the butt 22 is curved from the upper heel 28 to the toe 32 so as to comfortably conform to the chest and upper arm of a user when the apparatus 10 is tucked against the shoulder in one (1) method of use.

The butt 22 tapers toward the approximate middle of the stock 20 from the toe 32 to the location of a grip 34. The grip 34 is configured to have a steeper angle cut into the butt 22 for more precise control of the apparatus 10 by a firing hand. The grip 34, in combination with the contoured thumbhole 58 presents a more natural position of a user's firing hand relative to their arm.

Figure 3:
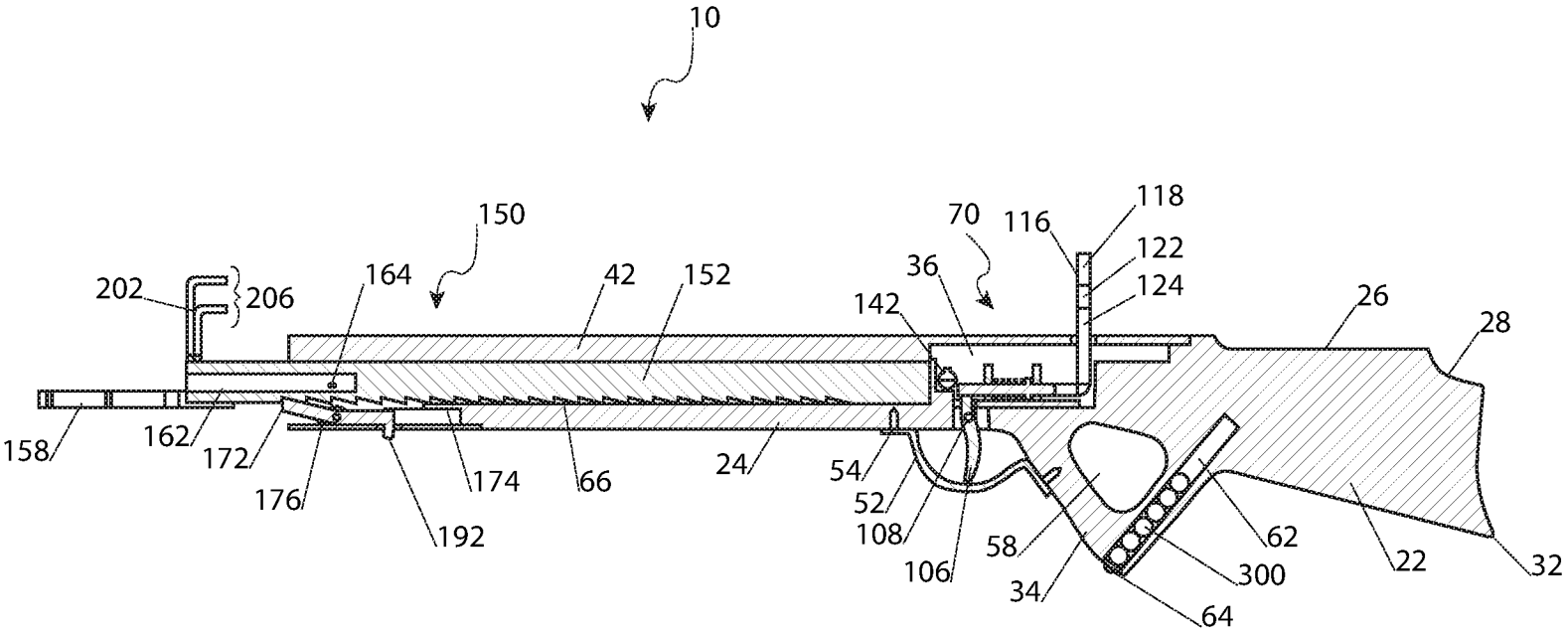
FIG. 3 is a side elevation view, in section taken along a line A-A of FIG. 1, of the slingshot long-weapon.
Figure 7:
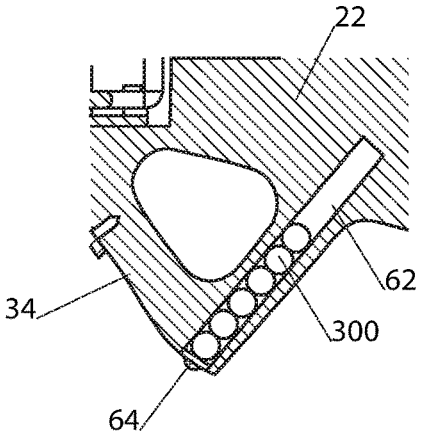
FIG. 7 is an enlarged, partial side elevation view, in section, of a projectile storage cavity of the slingshot long-weapon in accordance with one (1) embodiment of the present invention; and, FIG. 8 is an enlarged, partial side elevation view, in section, of a laser pointer of the slingshot long-weapon in accordance one (1) embodiment of the present invention.
Figure 8:
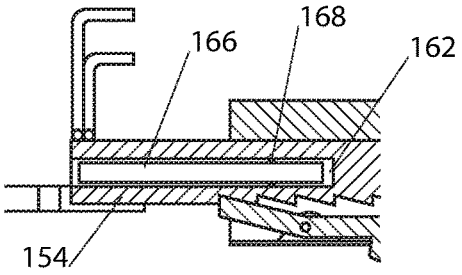

Referring to FIGS. 1, 3 and 7, a projectile storage cavity 62 is cut into the butt 22 in proximity to a lower end of the grip 34, as illustrated in FIGS. 3 and 7. The projectile storage cavity 62 is a cylindrical chamber oriented along a medial line perpendicular to a midline of the grip 34. The diameter of the projectile storage cavity 62 is slightly larger than the diameter of the projectiles 300 so as to accommodate a plurality of rounds of ammunition therein.

A cap 64 is intended to be inserted into the open end of the projectile storage cavity 62 so as to retain the projectiles 300 for a future use. The cap 64 and the projectile storage cavity 62 may be provided with complimentary threads of any form so as to render the cap 64 removable. Other methods, such as an interference fit, may also be utilized for the retention of the cap 64 within the projectile storage cavity 62 without limiting the scope of the present disclosure.

Referring to FIGS. 1, 2 and 3, the fore-end 24 is configured to have a square, or rectangular, cross-section with a slide cavity 66 (see FIG. 3) located along a medial horizontal plane. The slide cavity 66 is capable of accommodating the insertion of nearly all of a slide member 152 preferably having an inverted triangular cross-section. The slide member 152 is configured to protrude from the end of the slide cavity 66 approximately two inches (2 in.) in a collapsed position, as seen in FIG. 1.

The slide member 152 is composed of an aluminum alloy to advantageously exploit the low density of that material in comparison to other metals. The slide member 152 is provided with a smooth crest 154 along an upper planar face. A lower side of the slide member is provided with a plurality of detents 156 (see FIGS. 2 and 3) capable of accepting the insertion of a distal end of a latch bar 172 (see FIG. 3) in a manner that allows relative motion between the slide member 152 and the fore-end 24 in an extendable direction and arrests that motion in an opposite direction.

The slide cavity 66, and the slide member 152, are covered by a top plate 42 as a serviceable access to, and manner of assembly for, the slide member 152 and the action 70. The top plate 42 is adapted to have an appropriate cross-section along the length so as to adequately fill any gaps that may exist between the slide member 152, the slide cavity 66, the action 70, and an action cavity 36 (see FIG. 3). The top plate 42 is secured to the stock 20 with a plurality of threaded plate fasteners 44 inserted through apertures (not specifically shown) in the top plate 42.

Referring to FIGS. 1, 2, 3 and 8, a laser cavity 162, for the insertion of a laser pointer 166, is disposed at a distal end of the slide member 152. The laser cavity 162 is aligned along a central axis of the slide member 152 and penetrates the slide member 152 to a sufficient depth to enclose the laser pointer 166. The laser pointer 166 is configured to be any commercially available, generally cylindrical, light amplification device having a sufficient power level to project a coherent beam of light of a desirable wavelength over a distance to which the apparatus 10 may be capable of delivering the projectile 300. The laser pointer 166 is envisioned to be removably attached to the interior of the laser cavity 162 by a resilient mounting ring 168 (see FIG. 8) fitted around the periphery, or a portion of the periphery, of the laser pointer 166 and retained within the laser cavity by an interference fit.

A plurality of adjustment screws 164 (see FIG. 3) is disposed along the perimeter of the slide member 152 and configured to project into the laser cavity 162 so as to contact the laser pointer 166 to modify the beam path of the emitted light to correspond to a trajectory of the projectile 300.

Figure 6:
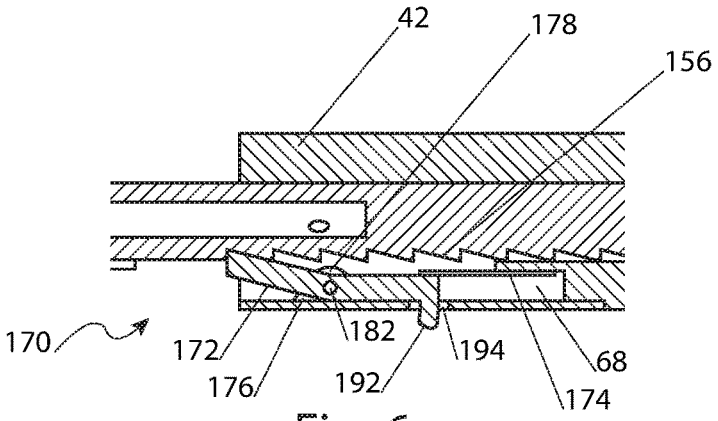
FIG. 6 is an enlarged, partial side elevation view, in section, of a slide latch mechanism of the slingshot long-weapon in accordance with one (1) embodiment of the present invention.

Referring to FIGS. 3 and 6, disposed at an open end of the slide cavity 66 is a slide latch mechanism 170 (see FIG. 6). The slide latch mechanism 170 includes a latch bar 172 and a latch spring 174 retained in a latch cavity 68 of the fore-end 24. The latch bar 172 is pivotally attached to a latch plate 184 by a latch pin 182 inserted through aligned apertures (not specifically illustrated) in the latch bar 172 and the latch bar devises 178. The latch bar 172, the latch plate 184, and the latch bar devises 178 are composed of metal having a coating, or plating, to inhibit deterioration. The latch bar devises 178 are permanently attached to the latch plate, either by welding, or by a sequence of metal forming procedures, such as forging and machining. A proximal end of the latch bar 172 is provided with an integral latch release button 192. The latch plate 184 is adapted to have a button aperture 194 through which the latch release button 192 extends. The distal end of the latch bar 172 is retained within a detent 156 of the slide member 152 by means of the force exerted upon the proximal end of the latch bar 172 by the latch spring 174 operating through the latch bar pivot 176.

Referring to FIGS. 1, 2, 3 and 6, the loop-shaped foothold 158 is attached to the distal end of the slide member 152. In use, an operator of the apparatus 10 places the foothold 158 on, or in very close proximity to, the ground, or other lower horizontal support surface, and by inserting a foot into the foothold 158 can stabilize the slide member 152 while pulling the stock 20 away from the slide member 152 so as to result in the extension of the slide member 152 from the slide cavity 66 (see FIG. 3). The retraction of the slide member 152 into the slide cavity 66 can be achieved by depressing the latch release button 192 sufficiently so as to cause the latch bar 172 to rotate about the latch bar pivot 176 thereby removing the distal end from engagement with any of the detents 156 and pushing the slide member 152 into the slide cavity 66 of the fore-end 24 (see FIG. 6).

Referring to FIGS. 1 and 2, the sling 200 is positioned atop the distal end of the slide member 152 along a crest 154. The sling 200 includes a firing yoke 202 and the attached rubber bands 212 with the pouch 214 positioned at a midpoint along the rubber bands 212. The firing yoke 202 is configured to be two (2) vertical yoke arms 204 having double ends 206 attached to a horizontal member 208 in a standard slingshot arrangement.

The rubber bands 212 are composed preferably of a natural, or synthetic, rubber that has been vulcanized to cross-link the polymer chains and improve other mechanical properties. The firing yoke 202 is configured with the double end 206 on each yoke arm 204 so as to support the utilization of two (2) rubber bands 212 at each side of a pouch 214.

The pouch 214 is composed of a split leather of approximately three inches (3 in.) in length. The pouch 214 is provided with a plurality of pouch apertures 216 along each side edge to which the rubber bands 212 may be secured by any appropriate means.

Figure 4:
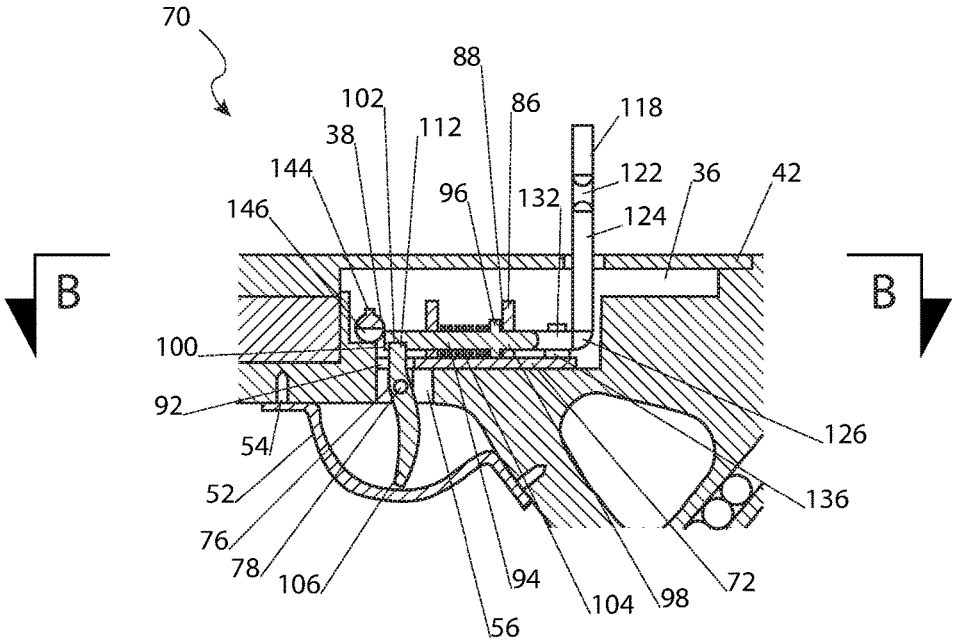
FIG. 4 is an enlarged, partial side elevation view, in section, of an action of the slingshot long-weapon in accordance with one (1) embodiment of the present invention.
Figure 5:
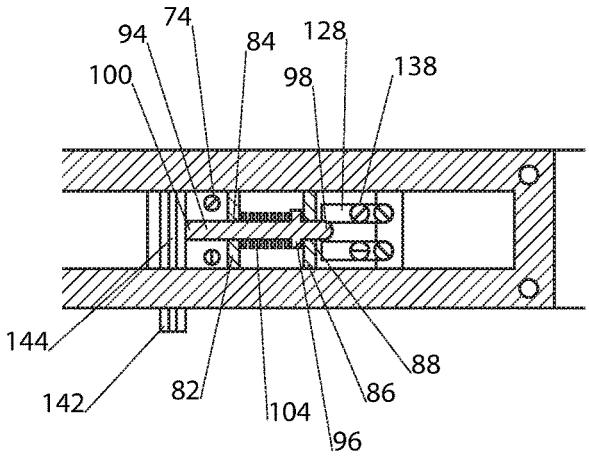
FIG. 5 is an enlarged, partial top plan view, in section taken along line B-B of FIG. 4 of the slingshot long-weapon.

Referring to FIG. 3, a section view along line A-A as shown in FIG. 1, FIG. 4, an isolated section view, and FIG. 5, a section view along line B-B as seen in FIG. 4, of the apparatus 10 are disclosed. The action 70 is adapted to be a projectile release mechanism housed within an action cavity 36 in the stock 20 of the apparatus 10. The action cavity 36 is configured to be of a sufficient size, having any appropriate number of internal planar, or convoluted, surfaces, to provide a clearance for moving parts of the action 70 and support for those portions of the action 70 that are intended to be stationary. A specific trigger gap 56 (see FIG. 4) is provided in the action cavity 36 for the movement of the trigger 106 in use. The trigger gap 56 may be provided with a seal (not shown) to obviate the entrance of any contaminants into the action 70.

Referring to FIG. 4, a mounting plate 72 is attached to a lower horizontal face of the action cavity 36 by means of a plurality of appropriate threaded mounting plate fasteners 74. Disposed on a lower face of the mounting plate 72 is a trigger clevis 76, configured to be a pair of trunnion plates with aligned apertures (not specifically shown) for the installation of a trigger pivot pin 78 about which the trigger 106 can execute a partial rotation. A trigger notch 92 is formed into a leading edge of the mounting plate 72 to provide clearance through which a firing pin actuator 112 of the trigger 106 may project. The firing pin actuator 112 is an upper portion of the trigger 106.

Referring to FIGS. 4 and 5, attached to an upper face of the mounting plate 72 are a front plate 82 and a rear plate 86. The front plate 82 and the rear plate 86 are oriented perpendicularly to the mounting plate 72 along two (2) axes. The front plate 82 is provided with a front plate aperture 84, while the rear plate 86 has a rear plate aperture 88 aligned along a longitudinal axis with the front plate aperture 84.

A generally cylindrical firing pin 94 is installed between the front plate 82 and the rear plate 86, having a first end 98 projecting through the rear plate aperture 88 and a second end 100 projecting through the front plate aperture 84.

A flange 96, configured to be an annular ring, is disposed near the first end 98 of the firing pin 94. The flange 96 is operationally located between the front plate 82 and the rear plate 96. The diameter of the flange 96 is larger than the second plate aperture 88 so as to prevent the front of the firing pin 94 from passing through the second plate aperture 88.

A trigger groove 102 (see FIG. 4) is disposed in a lower side of the firing pin 94 in proximity to the second end 100 of the firing pin 94. The trigger groove 102 is sized to conform to the firing pin actuator 112 of the trigger 106. A compression-type return spring 104 is assembled around the firing pin 94 and trapped between a rear face of the front plate 82 and a front face of the flange 96. The rear face of the flange 84 is held against the front face of the second plate 86 by the force exerted by the return spring 104. The first end 98 is configured to be hemispherical in shape and extends between the base rods 128 (see FIG. 5) of the retaining fingers 116, 134 (see FIGS. 1 and 2) in order to keep those fingers 116, 134 stationary.

Referring to FIGS. 1, 2, 4 and 5, the first finger 116 and the second finger 134 are configured to be symmetrical about a central axis. The fingers 116, 134 are generally cylindrical rods with a horizontal base rod 128 (see FIG. 5) attached to a finger pivot post 136 (see FIG. 4) affixed to the mounting plate 72. The longitudinal axis of the base rod 128 is aligned parallel to the longitudinal axis of the mounting plate 72.

The first finger 116 and the second finger 134 are secured by means of threaded finger pivot fasteners 138 (see FIG. 5) inserted into apertures (not specifically shown) in the base rod 128 thereby forming finger pivots 132 (see FIG. 4).

Referring to FIGS. 1 and 4, the fingers 116, 134 are "L"-shaped with a ninety degree (90°) bend 126 (see FIG. 4) at a rear side of the base rod 128. A vertical 124 yields to an outwardly opposing curve 122 in each of the first finger 116 and the second finger 134. Each finger 116, 134 then terminates in a vertical first end 118. The fingers 116, 134 project through a finger aperture 46 (see FIG. 1) in the top plate 42 so as to be accessible on the exterior of the apparatus 10.

Referring to FIGS. 4 and 5, a safety pin 142 is positioned in proximity to the second end 100 of the firing pin 94. The safety pin 142 is a cylindrical pin inserted through a safety pin aperture 38 (see FIG. 4) in the stock 20 so as to protrude some distance on a side and capable of being extended on one (1) side or the other.

Disposed in the safety pin 142 is a gap 146 (see FIG. 4) shaped to comply with the profile of the cylindrical firing pin 94. The gap 146 is located off of the midline position such that when the safety pin 142 is adjusted to protrude on a given side of the stock 20, the gap 146 is in alignment with the firing pin 94 and the firing pin 94 can be moved forward by the action of rotating the trigger 106 about the trigger pivot 108 (see FIG. 3) thereby firing the apparatus 10. When the safety pin 142 is adjusted to protrude on the opposite side of the stock 20, the gap 146 is moved out of alignment with the firing pin 94 thereby prohibiting the firing of the apparatus 10.

A safety pin spline 144 (see FIG. 4) may be formed on the safety pin 142 so as to prevent the gap 146 from improperly rotating out of a possible alignment with the firing pin 94.

Referring to FIGS. 1-4, a trigger guard 52 is attached to the stock 20 by means of at least one (1) threaded trigger guard fastener 54 (see FIG. 4). The trigger guard 52 is configured to be a formed partial enclosure surrounding some part of the trigger 106 as a precaution against the inadvertent actuation of the trigger 106 resulting in the accidental discharge of the apparatus 10.

Referring to FIGS. 1-8, in use, a projectile 300 is inserted into the pouch 212 by folding each side of the pouch 212 over the projectile 300. The folded pouch 212 is then placed between the fingers 116, 134 with the projectile positioned at the opposing curves 122. At this point the first end 98 of the firing pin 94 is located between the base rods 128 of the fingers 116, 134, as shown in FIG. 5, so as to minimize the distance between the opposing curves 122 and retain the pouch 212, with the enfolded projectile 300, by the fingers 116, 134. The first end 98 of the firing pin 94 is held in position by the force of the return spring 104. The rubber bands 212 are then extended by adjusting the position of the slide member 152 relative to the fore-end 24 so as to store energy in the rubber bands 212. The safety pin 142 may be adjusted at this time to obviate an inadvertent launch of a projectile 300. When the projectile 300 is intended to be released, the safety pin 142 can be adjusted so to disengage from the second end 100 of the firing pin 94 and to allow the firing pin 94 to be operated. After taking aim at a target, the trigger 106 can be actuated to slide the firing pin 94 forward to compress the return spring 104 and remove the first end 98 of the firing pin 94 from between the base rods 128 of the fingers 116, 134. This will allow the fingers 116, 134 to rotate about the finger pivots 132 thereby permitting the opposing curves 122 to separate to release the projectile 300.

Referring to FIGS. 1-8, in one particular, non-limiting example, the apparatus 10 includes the stock 20. The stock 20 includes the butt 22, the fore end 24 extending from the butt 22, wherein the fore end 24 includes the slide cavity 66. The stock includes the grip 34 positioned between the butt 22 and the fore end 24, wherein the grip 34 includes a thumbhole 58. The stock 20 includes the trigger guard 52 adjacent to the grip 34. The apparatus 10 includes the slide member 152 movably connected to the fore end 24 within the slide cavity 66 between a rearward slide member position and a forward slide member position, wherein the slide member includes a first end located within the slide cavity 66, and an opposed second end at least partially extending outwardly from the fore end 24. The apparatus 10 includes the sling 200 connected to the second end of the slide member 152, wherein the sling 200 includes a firing yoke 202. The firing yoke 202 includes the horizontal yoke member 208 connected to the second end of the slide member 152, and the perpendicularly opposed pair of vertical yoke arms 204 connected to the horizontal yoke member 208. The sling 200 includes the rubber bands 212 including a first end and an opposed second end, wherein the first end of each one of the rubber bands 212 is connected to an associated one of the pair of vertical yoke arms 204, the rubber bands 212 configured to be drawn back under tension to project the projectile 300 upon release of the tension. The sling 200 includes the pouch 214 connected to the second end each one of the rubber bands 212. The apparatus 10 includes the foot hold 158 connected to the second end of slide member 152. The apparatus 10 includes the firing action 70 disposed within the stock 20. The firing action 70 includes the firing pin 94 being movable between a forward firing pin position and a rearward firing pin position. The firing action 70 includes the pair of fingers 116, 134 being movable between a closed position to hold the rubber bands 212 under the tension and an open position to release the tension. The firing action 70 includes the trigger configured to one (1) of selectively retain the firing pin 94 in the rearward firing pin position or release the firing pin in the forward firing pin position. Wherein, when in the rearward slide member position, the slide member 152 moves the firing pin 94 in the rearward firing pin position. Wherein, when in the rearward firing pin position, the firing pin 94 retains the pair of fingers 116, 134 in the closed position.

Those skilled in the art will recognize that other styles and configurations of the disclosed apparatus 10 can be easily incorporated into the teachings of the present disclosure, and only particular configurations have been shown and described for purposes of clarity and disclosure and not by way of limitation of scope.

The example embodiments of the present invention can be utilized by the common user in a simple and effortless manner with little or no training. After initial purchase or acquisition of the apparatus 10, it would be arranged and utilized as indicated in FIGS. 1-8.

One (1) embodiment of the disclosed method for utilizing the apparatus 10 may be include a series of steps, including: acquiring a model of the apparatus 10 having a desired style to suit the taste of a user; adjusting the laser pointer 166 to properly "sight-in" the apparatus 10; removing the cap 64 from the projectile storage cavity 62; inserting additional projectiles 300 into the projectile storage cavity 62; replacing the cap 64 onto the projectile storage cavity 62; transporting the apparatus 10 to the desired location; retrieving a projectile from the projectile storage cavity 62; inserting a projectile 300 into the pouch 212; inserting the folded pouch 212 into the gap between the retaining fingers 116, 134 as previously described; adjusting the safety pin 142 to prohibit the displacement of the firing pin 94; extending the rubber bands 212 by extending the slide member 152 from the fore-end 24; activating the laser pointer 166; placing the butt 22 of the stock against the selected shoulder; grasping the grip 34 of the stock 20 with the preferred hand; placing the trigger finger into the trigger guard 52; supporting the fore-end of the apparatus with the off-hand; placing the light beam of the laser pointer 166 on the target; adjusting the safety pin 142 to permit the launch of the projectile 300; depressing the trigger 106 with the trigger finger thereby releasing the projectile 300 to follow the intended trajectory to the target.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A weapon comprising:

a stock;

a slide member connected and linearly movable relative to said stock, said slide member being movable between a rearward slide member position and a forward slide member position;

a sling connected to said slide member and configured to be drawn back under tension to project a projectile upon release of said tension; and, a firing action configured to selectively retain said sling in a drawn back position and release said sling to project said projectile, further comprising:

a firing pin being movable between a forward firing pin position and a rearward firing pin position; and, a pair of fingers being movable between a closed position to hold said sling in said drawn back position under said tension and an open position to release said sling;

wherein, when in said rearward slide member position, said slide member moves said firing pin in said rearward firing pin position; and, wherein, when in said rearward firing pin position, said firing pin retains said pair of fingers in said closed position.

2. The weapon of claim 1, wherein said firing action further comprises a trigger configured to one of selectively retain said firing pin in said rearward firing pin position or release said firing pin in said forward firing pin position.

3. The weapon of claim 1, wherein, when said sling is in said drawn back position, moving said slide member from said rearward slide member position to said forward slide member position further increases said tension applied to said sling.

4. The weapon of claim 3, wherein said slide member is lockable in one of a plurality of forward slide positions.

5. A weapon comprising:

a stock comprising a slide cavity;

a slide member connected to said stock and linearly movable relative to said stock within said slide cavity between a rearward slide member position and a forward slide member position, said slide member comprising a slide member first end and a slide member second end, at least a portion of said slide member about said slide member second end extends outwardly from said slide cavity, further comprising:

a top surface comprising a flat crest; and, a bottom surface comprising a plurality of detents;

a slide latch mechanism disposed within said slide cavity, said slide latch mechanism engages said slide member to allow linear movement of said slide member out from said slide cavity and selectively restrain linear movement of said slide member into said slide cavity, further comprising:

a latch bar selectively engaged to said slide member bottom surface and in contact with one of said plurality of detents to prevent said linear movement of said slide member into said slide cavity;

a latch spring connected to said latch bar to bias said latch bar into engagement to said slide member bottom surface; and, a latch release button connected to said latch bar to disengage said latch bar away from said slide member bottom surface and allow linear movement of said slide member into said slide cavity;

a sling connected to said slide member second end, said sling configured to be drawn back under tension to project a projectile upon release of said tension; and, a firing action configured to selectively retain said sling in a drawn back position and release said sling to project said projectile.

6. The weapon of claim 5, wherein, when said sling is in said drawn back position, moving said slide member from said rearward slide member position to said forward slide member position further increases said tension applied to said sling, and wherein said slide latch mechanism locks said slide member in one of a plurality of forward slide positions.

7. The weapon of claim 5, wherein said slide member comprises a laser cavity formed within said second end, and wherein said laser cavity is suitably sized and shaped to hold a laser pointer.

8. The weapon of claim 7, wherein said slide member further comprises a plurality of adjustment screws extending within said laser cavity to engage said laser pointer and adjust a position of said laser pointer within said laser cavity.

9. The weapon of claim 5, wherein said stock further comprises:

a butt;

a fore end extending from said butt, wherein said slide cavity is formed at least partially within said fore end;

a grip positioned between said butt and said fore end, said grip comprising a thumbhole;

an action cavity configured to store said action; and, a trigger guard adjacent to said grip.

10. The weapon of claim 9, wherein said butt comprises:

a projectile storage cavity suitably sized and shaped to hold a plurality of projectiles; and, a cap removably connected to said butt to enclose said projectile storage cavity.

11. The weapon of claim 5, further comprising a foothold connected to said slide member second end.

12. The weapon of claim 5, wherein said sling comprises:

a firing yoke comprising:

a horizontal yoke member connected to said slide member second end; and, a opposed parallel pair of vertical yoke arms perpendicularly connected to said horizontal yoke member;

rubber bands connected to said firing yoke and configured to be drawn back under said tension, each one of said rubber bands comprising a rubber band first end and an opposed rubber band second end, said rubber band first end is connected to one of said pair of vertical yoke arms; and, a pouch connected to said rubber band second end.

13. The weapon of claim 12, wherein each one of said pair of vertical yoke arms comprises two rubber band connecting ends, and said first end of each one of said rubber bands is connected to one of said rubber band connecting ends.

14. The weapon of claim 5, wherein said firing action comprises:

a firing pin being movable between a forward position and a rearward position;

a pair of fingers being movable between a closed position to hold said sling under said tension and an open position to release said sling; and, a trigger configured to one of selectively retain said firing pin in said rearward firing pin position or release said firing pin in said forward firing pin position;

wherein, when in said rearward slide member position, said slide member moves said firing pin in said rearward firing pin position; and, wherein, when in said rearward firing pin position, said firing pin retains said pair of fingers in said closed position.

15. The weapon of claim 14, wherein said firing action further comprises:

a mounting plate connected to said stock;

a front plate connected to said mounting plate and comprising a front plate aperture; and, a rear plate connected to said mounting plate and comprising a rear plate aperture;

wherein said firing pin is positioned between said front plate and said rear plate; and, wherein said fingers are rotatably connected to said mounting plate.

16. The weapon of claim 15 wherein said firing pin comprises:

a firing pin first end projecting through said rear plate aperture;

a firing pin second end projecting through said front plate aperture;

a firing pin flange extending radially from about said firing pin first end between said front plate and said rear plate, said firing pin flange being sized to limit linear movement of said firing pin through said rear plate aperture; and, a trigger groove disposed about said firing pin second end; and, a firing pin spring positioned around said firing pin and between said front plate and said firing pin flange, said firing pin spring biasing said firing pin in said forward position.

17. The weapon of claim 16 wherein said trigger comprises:

a firing pin actuator;

wherein said firing pin actuator is in selective engagement with said trigger groove; and, wherein, when said firing pin actuator is engaged with said trigger groove, said trigger retains said firing pin in said rearward position.

18. A weapon comprising:

a stock comprising:

a butt;

a fore end extending from said butt, wherein said fore end comprises a slide cavity;

a grip positioned between said butt and said fore end, wherein said grip comprises a thumbhole; and, a trigger guard adjacent to said grip;

a slide member movably connected to said fore end within said slide cavity between a rearward slide member position and a forward slide member position, wherein said slide member comprises:

a first end located within said slide cavity; and, an opposed second end at least partially extending outwardly from said fore end;

a sling connected to said second end of said slide member, wherein said sling comprises:

a firing yoke comprising:

a horizontal yoke member connected to said second end of said slide member; and, a perpendicularly opposed pair of vertical yoke arms connected to said horizontal yoke;

rubber bands comprising a first end and an opposed second end, wherein said first end of each one of said rubber bands is connected to an associated one of said pair of vertical yoke arms, said rubber bands configured to be drawn back under tension to project a projectile upon release of said tension;

a pouch connected to said second end each one of said rubber bands;

a foot hold connected to said second end of slide member;

a firing action disposed within said stock, wherein said firing action comprises:

a firing pin being movable between a forward firing pin position and a rearward firing pin position; and, a pair of fingers being movable between a closed position to hold said rubber bands under said tension and an open position to release said tension; and, a trigger configured to one of selectively retain said firing pin in said rearward firing pin position or release said firing pin in said forward firing pin position;

wherein, when in said rearward slide member position, said slide member moves said firing pin in said rearward firing pin position; and, wherein, when in said rearward firing pin position, said firing pin retains said pair of fingers in said closed position.

* * * * *